United States Patent [19]

Rhee

[11] 4,062,073

[45] Dec. 13, 1977

[54] PROTECTIVE DEVICE FOR THE ARM AND HAND USEFUL IN OPERATING AN OPEN VEHICLE

[76] Inventor: Jhoon Goo Rhee, 2525 N. Ridgeview Road, Arlington, Va. 22207

[21] Appl. No.: 554,081

[22] Filed: Feb. 28, 1975

[51] Int. Cl.[2] ..... A41D 13/08

[52] U.S. Cl. ..... 2/16

[58] Field of Search ..... 2/16, 17, 18, 20, 158, 2/159, 161 A, 2

[56] References Cited

U.S. PATENT DOCUMENTS

| | | | |
|---|---|---|---|
| 571,020 | 11/1896 | Royce | 2/17 |
| 2,082,574 | 6/1937 | Handley | 2/16 |
| 2,572,360 | 10/1951 | Logan | 2/2 |
| 2,904,792 | 9/1959 | Elliott | 2/16 |
| 3,002,192 | 10/1961 | Brower | 2/16 |
| 3,446,880 | 5/1969 | Enicks | 2/2 |
| 3,924,272 | 12/1975 | Allen et al. | 2/16 |

FOREIGN PATENT DOCUMENTS

| | | | |
|---|---|---|---|
| 456,677 | 5/1949 | Canada | 2/16 |
| 353,055 | 9/1905 | France | 2/16 |
| 12,188 | 7/1900 | United Kingdom | 2/16 |

*Primary Examiner*—Werner H. Schroeder
*Assistant Examiner*—Peter Nerbun
*Attorney, Agent, or Firm*—M. Ted Raptes

[57] ABSTRACT

This invention relates to a protective device adapted to protect the arms and hands of a driver or operator of an open vehicle such as a motorcycle, etc. The device is constructed from a resilient material, such as a plastic foam, covered with a tough, pliable plastic material or the like, and comprises a tubular member with openings at both ends. One opening is contoured to cradle the wearer's elbow and permit movement of the arm. The other opening comprises a contoured section permitting movement of the wrist of a wearer, and also comprises a flat section which is an extension of the tubular member with a curved end. Suitable fastening means are disposed in the flat section adapted to receive fingers of the hand of the wearer.

5 Claims, 4 Drawing Figures

PROTECTIVE DEVICE FOR THE ARM AND HAND USEFUL IN OPERATING AN OPEN VEHICLE

BACKGROUND OF THE INVENTION plastic foam,

This invention relates to a protective device or shield adapted to be worn on a person's arm when driving an open vehicle such as a motorcycle or bicycle. When driving such a vehicle, a person normally has each hand on a respective handlebar of the vehicle for steering purposes, and also for operating various levers, such as for the brakes. Especially when operating a motorcycle at relatively normal speeds, the elements such as wind, rain, snow, cold, etc., can interfere with careful operation of the vehicle, because they can affect the operator's arms and hands. Operators can wear gloves, but their use can interfere with manual dexterity desired, and the arm is still inadequately protected unless a jacket with long sleeves is also worn. In many instances, the wearing of gloves interferes with proper operation of the operating levers of the vehicle. The present invention provides a novel protective device adapted to shield and protect an open vehicle rider's arm and hand.

SUMMARY OF THE INVENTION

It is an object of this invention to provide a novel device for protecting and shielding an open vehicle operator's arm and hand, which can easily be put on and taken off.

Another object of this invention is to provide a novel protective device for the arm and hand of simplified construction, comprising a resilient plastic foam covered with a tough, pliable plastic material, which is relatively inexpensive, and which permits the wearer excellent manual dexterity when operating a vehicle.

A further object of the invention is to provide a device for wearing on a person's arm and hand which protects against the elements of wind, rain, etc., and also protects the arm in the event of an accident.

Generally, the protective shield comprises a tubular device made from a resilient material having a tough, outercoating, preferably of plastic which is shaped and adapted to be worn and generally covers the arm from the elbow to across the back of the hand and fingers while leaving the palm uncovered. Suitable means are provided for securing the device to the fingers.

DETAILED DESCRIPTION OF THE INVENTION

Figure 1:
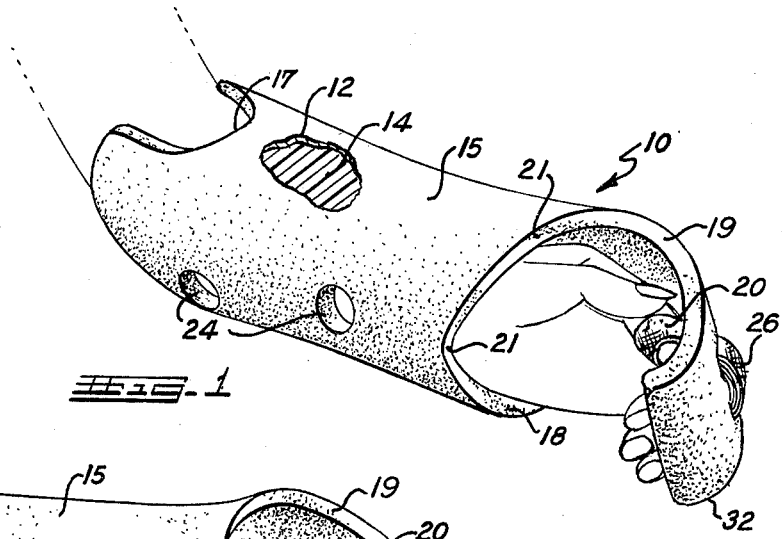
FIG. 1 is a perspective view of the device as worn on the arm.

The embodiment of the invention disclosed in the drawing comprises a device generally indicated by the numeral 10. The device, preferably unitary, is formed or molded from a suitable resilient material 14 capable of absorbing energy, such as plastic, i.e., polystyrene or polyurethane foam, or a rubber foam, and the like. A suitable surface coating or casing 12, preferably smooth, covers the entire resilient material throughout, and which is a tough, pliable, tear resistant material, preferably of a suitable plastic material, or the like. The coating 12 can be formed during heating or molding of the resilient foam material to produce a fused coating thereon. Alternatively, the surface coating 12 can be applied on the resilient material by dipping or by applying and securing a coating of a suitable plastic material or the like. Materials of plastic are preferred for the coating since there are available on the market many tough, rugged, pliable materials such as polyvinylchloride, etc. However, it is also contemplated within the concept of the invention that suitable rugged leather or fabric materials, and the like, can be secured to the resilient material and used to cover the resilient material. The coating or casing used should provide a flexible, tough covering which is resistant to tearing or abrasion.

The device 10 comprises a generally, longitudinal, tubular member 15 having a contoured opening 16 at one end, an opening 18 at the opposite end, a flat portion 19 containing a curved end 32, and finger fastening means 26.

The device is worn by putting the hand and arm through the opening 16, extending them through the tubular portion 15, extending the back of the hand through opening 18 and the flat portion 19, while extending two fingers into the strap loops 20 and 22 of the fastening means 26 and resting the ends of the fingers across the curved portion 32.

The device as worn (FIG. 1) cradles the elbow at the bottom 31 of opening 16. Opening 16 is contoured at the rear portion 30 and at the forward portion 17. This permits the upper part of the arm, above the elbow, to freely move or pivot within the opening 16. Thus, the elbow can be flexed and either the upper arm or lower arm moved normally.

Figure 3:
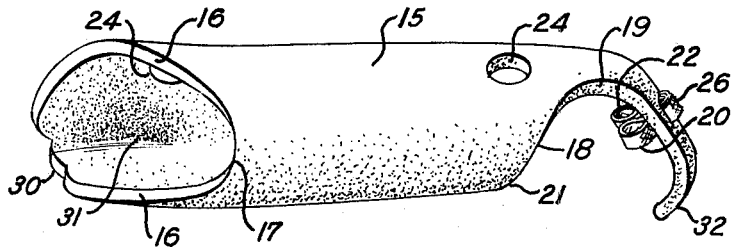
FIG. 3 is a side elevational view of the device showing details of the elbow opening.
Figure 4:
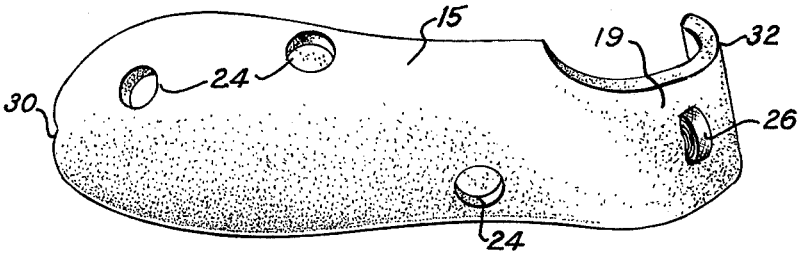
FIG. 4 is an elevational view taken from the side opposite that shown in FIG. 3.

Opening 18 is provided with a contoured portion 21 which permits the hand to be freely flexed at the wrist. The flat portion 19 extending beyond opening 18 and over the back of the hand and fingers is adapted to be flexible and is normaly angled inwardly as shown in FIG. 3. The end portion 32 is flexible and is curved further inwardly to an almost 90°angle to the flat portion 19. Fastening means 26 are adapted to be disposed in or through flat portion 19 providing loops 20 and 22 for insertion of fingers therein. With fingers inserted, the hand, fingers and thumb are free to perform any normal function, such as grasping the handlebars of a vehicle, operating levers, turning knobs, etc. When the hand and fingers are flexed, the protective portions 19 and 32 are flexed along therewith.

Figure 2:
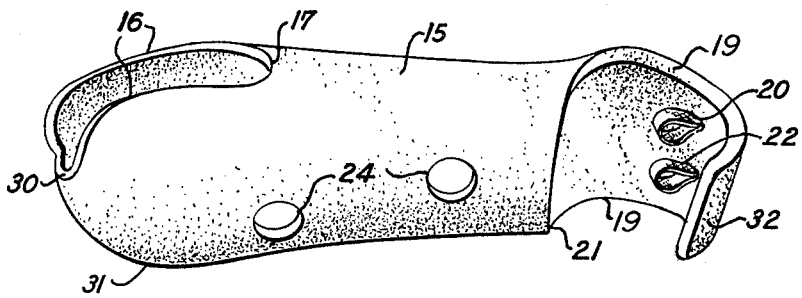
FIG. 2 is a side perspective view of the device similarly as shown in FIG. 1, but not worn on the arm and showing details of the hand section.

The opening 16 is disposed or turned about 90°from the opening 18, i.e., the vertical plane through the center of opening 16 bisecting 30 and 17 is turned 90°from a horizontal plane through opening 18 bisecting 21 and 19 as seen in FIG. 2. In this manner, the device properly fits the arm and fingers when they are in a normal position on the handlebars of a vehicle.

As worn and in use when driving a vehicle, the device 10 protects the arm, the back of the hand and fingers against the elements while not restricting normal manual dexterity of the fingers in movement of the arm. The device also protects the arm, hand and fingers in the event of an accident. In order to provide ventilation to the inner tubular part of the device, ventilation holes 24 are provided.

From the foregoing description, one skilled in the art can easily ascertain the essential characteristics of this invention, and without departing from the spirit and scope thereof, can make various changes and modifications of the invention to adapt it to various usages and conditions.

What is claimed is

1. A flexible, unitarily molded, protective device for wearing on and protecting the arm and hand of a driver of an open vehicle comprising casing means having resilient foam means disposed therein and having a generally tubular configuration open at both ends and adapted to extend between the elbow and hand of the wearer, one open elbow end comprising contoured portions adapted to cradle the wearer's elbow and to permit movement of the upper part of the wearer's arm therein and to accommodate bending of the elbow, the second open hand end comprising a contoured portion adapted to permit movement of the wrist of the wearer, a flat extension of said second open end normally angled substantially inwardly and terminating in a inwardly extending portion, said extension adapted to cover the back of the hand and curved fingers of the wearer, with the sides of the hand left uncovered a plane through said elbow portion bisecting said contoured portions thereof being disposed at about a 90°angle with respect to a plane through said open hand end bisecting said contoured portion thereof and said flat extension, and securing means disposed in said flat extension for retaining said device on said fingers whereby the wearer's fingers can hold the device in position with the wearer's thumb being unattached.

2. The device of claim 1 wherein hole means are disposed between said elbow end and said open hand end in said device for ventilating purposes.

3. The device of claim 1 wherein said securing means include strap means comprising loop means disposed on the inner surface of said flat extension adapted to receive said fingers.

4. The device of claim 1 wherein said inwardly extending portion is disposed inwardly about 90°with respect to said flat extension of said second open end.

5. The device of claim 1 wherein said casing comprises a plastic material and said resilient means are plastic foam means.

* * * * *